United States Patent [19]

Shinagawa et al.

[11] 4,039,333

[45] Aug. 2, 1977

[54] PHOTOGRAPHIC MATERIALS HAVING IMPROVED ANTI-HALATION LAYERS

[75] Inventors: Yukio Shinagawa; Yasumasa Yamaguchi; Shuichi Shindo, all of Minami-ashigara, Japan

[73] Assignee: Fuji Photo Film Co., Ltd., Minami-ashigara, Japan

[21] Appl. No.: 676,785

[22] Filed: Apr. 14, 1976

[30] Foreign Application Priority Data

Apr. 14, 1975 Japan ..... 50-44951

[51] Int. Cl.[2] ..... G03C 1/84

[52] U.S. Cl. ..... 96/84 R; 96/67

[58] Field of Search ..... 96/84 R, 84 UV, 67; 526/317

[56] References Cited

U.S. PATENT DOCUMENTS 3,764,587 10/1973 Zunken ..... 526/317

FOREIGN PATENT DOCUMENTS 2,429,141 1/1975 Germany 46-2783 10/1971 Japan

*Primary Examiner*—John D. Welsh

*Attorney, Agent, or Firm*—Sughrue, Rothwell, Mion, Zinn and Macpeak

[57] ABSTRACT

An anti-halation layer for photographic materials comprising at least one first binder which is swollen by an aqueous alkaline solution and comprises about 10 to about 25% by weight of alkyl acrylate units, 52 to 65% by weight of alkyl methacrylate units and about 18 to about 30% by weight of suitable acid monomer units, and at least a second binder agent which is soluble in an alkaline aqueous solution but which can withstand a strongly alkaline preliminary bath and is readily stripped away only at a successive rinsing operation.

8 Claims, No Drawings

PHOTOGRAPHIC MATERIALS HAVING IMPROVED ANTI-HALATION LAYERS

BACKGROUND OF THE INVENTION

1. Field of the Invention

The present invention relates to photographic materials having an anti-halation layer easily removable from one surface of a substrate which carries a light-sensitive photographic emulsion layer on the other surface.

2. Description of the Prior Art

The phenomenon of halation takes place due to the fact that light reflected by the substrate of a photographic material again reaches the photo-sensitive emulsion coating; halation can thus be prevented by a light-absorbing anti-halation layer provided on the surface of the substrate other than that on which the photographic emulsion coating is provided.

Such an anti-halation layer generally comprises a natural or synthetic binder containing dyes or pigments.

Anti-halation layers can be classified into two types; one is referred to as a "decolorizable type" in which dyes included in the antihalation layer are decolorized or bleached during developing, and the other is referred to as a "removal type" in which the anti-halation layer itself is removed from the substrate during development.

For the latter type of anti-halation layer, i.e., the removable type, there are employed binders which are soluble in an aqueous alkaline solution. As such binder materials, extensive investigations have been performed, some of which are disclosed in U.S. Pat. No. 2,327,828 and Japanese patent application (laid-open) No. 2783/1971.

In a certain type of developing for color photography, a preliminary bath, which is strongly alkaline and contains a high concentration of an inorganic slat such as sodium sulfate, is used. The role of such a preliminary bath is not to remove the anti-halation layer from the photographic substrate but to impart water solubility to the binder for the anti-halation layer by converting the binder from its water-insoluble acid form into the corresponding alkali metal salt form.

Suitable aqueous alkaline solutions for preliminary baths include an aqueous solution of one or more inorganic salts adjusted to a pH value of about 9 to about 11. Typical inorganic salts used are sodium sulfate ($Na_2SO_4$), sodium hydroxide (NaOH), borax ($Na_2B_4O_7$) or mixtures thereof. The concentration of the inorganic salts is usually about 8 to about 15 wt%, preferably about 9.5 to about 12 wt%. A small amount of one or more organic salts such as sodium formate, sodium acetate, etc., may be added, if desired. The most preferable concentration of the aqueous alkaline solution is 8.5 to 9.5 wt% of sodium sulfate, 1.7 to 2.0 wt% of borax and 0.08 to 0.1 wt% of sodium hydroxide.

Usually, to prevent contamination of the preliminary bath (scum formation) the binder of the anti-halation layer is formulated so that it does not dissolve in the preliminary bath, which is strongly alkaline, even when it is present in the form of alkali metal salt, due to a salting-out effect caused by the presence of a high concentration of the inorganic salt. After leaving the preliminary bath, the anti-halation layer is stripped or removed off when the material is washed with water prior to first development.

From the standpoint of preventing scum formation or contamination, it is preferred that the anti-halation layer never be stripped from the substrate in the preliminary bath. However, insofar as one relies on an alkali soluble binder, the resulting anti-halation layer always exhibits insufficient film strength, making it difficult to avoid contamination of the preliminary bath.

After passing through the preliminary bath, the photographic substrate is washed with water, whereby the anti-halation layer is removed. In some instances, water jets are employed to perfectly remove the layer at this stage.

However, it is quite difficult to formulate an anti-halation layer so as to permit complete removal by water jets alone, insofar as one relies on a binder which is soluble in an aqueous alkaline solution, e.g., if one uses a binder readily soluble in alkaline solutions to permit the removal of the anti-halation layer by water jets alone, the strength of the layer because too low to withstand the strongly alkaline preliminary bath, and the layer tends to be stripped from the substrate and cause severe contamination of the preliminary bath.

A practically acceptable film resistance for an anti-halation layer in a strongly alkaline preliminary bath requires a binder with a relatively low solubility in an alkaline solution. Usually water jets fail to remove all of such an anti-halation layer, leaving a very thin film on the substrate.

Thus, it is conventional in processing to bring the photographic material, after it has been washed with water, into contact with a rotating cylinder which is covered with a soft material and is subjected to running water to rub off the remaining anti-halation layer.

SUMMARY OF THE INVENTION

Therefore, one object of the present invention is to provide photographic materials having an anti-halation layer which can be readily and completely removed in a washing operation following a strongly alkaline preliminary treatment.

Another object is to provide photographic materials having an anti-halation layer which exhibits such a film strength that it is never stripped off in, nor contaminates, a strongly alkaline preliminary bath.

These and other objects of the present invention have been attained by adding a binder which is swollen by an aqueous alkaline solution to a conventional alkali soluble binder to form an anti-halation layer binder.

The present inventors have found that an anti-halation layer comprising such a combinations of binders not only has a sufficient film strength in a strongly alkaline preliminary bath but can also be removed quite readily and completely during a succeeding washing operation.

DETAILED DESCRIPTION OF THE INVENTION

As aqueous alkaline solution swellable binders of the present invention, terpolymers are desirably used which comprise about 18 to about 30% by weight of an acid monomer selected from acrylic, methacrylic and itaconic acid, about 10 to about 25% by weight of an alkyl acrylate having an alkyl group of from one to four carbon atoms, and 52 to 65% by weight of an alkyl methacrylate having an alkyl group of from one to four carbon atoms.

Such terpolymers are insoluble in water at room temperature, and sparingly soluble even in an aqueous alkaline solution at room temperature. However, once they are converted to their alkali metal salt form, they exhibit a substantial swelling in water.

In the aqueous alkaline solution swellable binder of the present invention, each monomer in the terpolymer is considered to have the following individual role.

The acid moiety comprising acrylic, methacrylic or itaconic acid is hydrophilic. When the content of the acid moiety exceeds about 30% by weight, the terpolymer because soluble in an aqueous alkaline solution, and when it is above about 35% by weight, the terpolymer becomes water soluble. Terpolymers with an acid content below about 18% by weight have a poor degree of hydrophilicity whereby a coating comprising such a terpolymer cannot be removed from a substrate.

Alkyl acrylates and alkyl methacrylates contribute to the hardness of the terpolymer. When the content of alkyl acrylate is below about 10% by weight or the content of alkyl methacrylate is above 65% by weight, the terpolymer becomes too hard, whereby the film does not fracture due to the distortion caused by swelling. Consequently the removal of the anti-halation layer becomes quite difficult. On the other hand, when the content of alkyl acrylate exceeds about 25% by weight or when the content of alkyl methacrylate is reduced to 52% by weight or lower, stripping of the resulting anti-halation layer due to film disintegration, which characterizes the present invention, hardly takes place.

The properties of alkali swellable binders for use in the present invention depend on the molecular weight thereof, the preferred range of which is from about 5,000 to about 200,000, preferably from 10,000 to 100,000, for the present purposes. One example of a most preferred binder as described is a terpolymer comprising 25% by weight acrylic acid, 20% by weight ethyl acrylate and 55% by weight methyl methacrylate.

A series of polymers are disclosed in Japanese patent application (laid-open) No. 2783/1971 which are similar to the aqueous alkali-swellable terpolymers disclosed in the present invention. However, the former are clearly different in the monomer components thereof, and, therefore, also in the properties. The polymers disclosed in Japanese patent application (laid-open) No. 2783/1971 contain from 1 to 50% by weight of alkyl methacrylate, while in the terpolymers of the present invention, the corresponding content lies between 52 and 65% by weight.

When a terpolymer with an alkyl methacrylate content of below 50% by weight is employed, the film dissolves in aqueous alkaline solutions, and also is so elastic that the layer cannot retain therein internal stress due to swelling of the layer sufficient to collapse the layer, so that removal of the layer as in the present invention cannot be effected, which is characteristic of the films of the present invention.

Aqueous alkali solution soluble binders are, in the present invention, blended with the heretofore described aqueous alkali solution swellable binder. With respect to the aqueous alkali solution soluble binders, preferably these binders have a molecular weight of from about 10,000 to about 200,000. The strength of coating layer is not sufficient when it is less than about 10,000, while the strength of coating layer is too strong to permit removal when it is more than about 200,000.

Such a binder having at least one free carboxyl group, preferably a copolymer containing an organic acid or organic acid anhydride or a cellulose derivative containing a carboxyl group is preferable. Examples of said aqueous alkali solution swellable binder are cellulose derivatives containing free carboxylic groups (e.g., cellulose acetate phthalate, cellulose acetate maleate, hydroxypropylmethylcellulose hexahydrophthalate, hydroxypropylmethylcellulose acetylphthalate or cellulose acetate succinate, etc.) copolymers of maleic anhyride and vinyl comonomers (maleic acid or anhydride generally being used at about 30 to about 60 mol% copolymerization ratio) such as styrene, vinyl acetate or alkyl acrylates containing $C_1$ to $C_4$ alkyl groups, copolymers containing acrylic acid (e.g., aqueous alkali solution soluble terpolymers comprising acrylic acid, ethyl acrylate and methyl methacrylate, etc.), polyvinyl phthalate, polyvinyl acetate phthalate, hydroxyalkylalkylcellulose tetrahydrophthalate (the alkyl group containing one to four carbon atoms), hydroxyalkylcellulose hexahydrophthalate (the alkyl group containing one to four carbon atoms) copolymers containing crotonic acid (e.g., a crotonic acid vinyl acetate copolymer, a crotonic acid styrene copolymer), etc.

A simple test will enable one skilled in the art to distinguish "soluble" and "swellable" materials. A terpolymer layer dipped in an alkaline solution for at least 30 sec is then dipped in water at 15° C and shaken for about 1 min. At this state, we observe the shaking solution. "Soluble" means the terpolymer is not observed at all and "swellable" means traces of the terpolymer can still observed.

Among the above-cited, aqueous alkali solution soluble binders, very preferred are cellulose derivatives and styrene maleic anhydride copolymers, and most preferred of said binders are cellulose acetatephthalate, hydroxypropylmethylcellulose acetylphthalate, hydroxypropylmethyl cellulose hexahydrophthalate, and styrene maleic anhydride copolymers.

The blending ratio of an aqueous alkali solution swellable binder to an aqueous alkali solution soluble binder depends on the kinds of binders employed to some extent, but generally it is effective to blend about 30 to about 400 parts by weight of an aqueous alkali solution swellable binder to 100 parts by weight of an aqueous alkali solution soluble binder. More preferably 50 to 300, and most preferably 100 to 250, parts by weight of an aqueous alkali swellable binder is used, same basis.

There is no limitation on the substrate, except, of course, materials which are easily solved in an organic solvent (e.g., n-propyl alcohol, acetone, methanol, methyl cellosolve acetate, etc.) of the coating composition containing an aqueous alkali solution soluble binder cannot be used for the substrate.

Suitable materials for the substrate used in the present invention include, for example, cellulose acetate butyrate, cellulose acetate propionate, cellulose triacetate, and polyesters, preferably, polyethylene terephthalate, polycarbonate, etc.

When the film of the present invention comprising an aqueous alkali solution swellable binder is subjected to rinsing with water after being treated in an alkaline preliminary bath, it drastically swells so as to enlarge its size by about 3 to about 10 times based on the original volume. If the anti-halation layer was composed of an aqueous alkali solution swellable binder alone, the film would not crumble and would keep its original shape.

On the contrary, when an aqueous alkali solution soluble binder was blended to form the anti-halation layer, the film instantaneously fell into pieces and was removed from the substrate when exposed to rinsing water after the preliminary treatment. We have thus found that films comprising such a binder blend are perfectly adapted for use as an anti-halation layer showing the above-described desirable performances.

Typical rinsing conditions involve a temperature of about 5° to about 35° C, and, while the time is generally more than about 10 seconds, preferably 30 to 45 seconds, time can be freely varied according to temperature and pressure used. Most commercial devices operate well at a water-jet rate of generally on the order of 5 liters/min., and this is often used.

An anti-halation layer which comprises a binder which is a blend of an aqueous alkali solution swellable polymer and an aqueous alkali solution soluble polymer exhibits a remarkably higher film strength in an alkaline preliminary bath compared with one comprising an aqueous alkali solution soluble binder alone, and is not worn away nor stripped off when scrubbed with rotating rollers.

Typically, the layer is scrubbed with rotating rollers in a processor after dipping an alkali preliminary bath but before rinsing.

Further, when a photographic material having such a prior art anti-halation layer is conveyed into a rinsing bath after leaving the alkaline preliminary bath, the anti-halation layer falls into pieces too suddenly to allow dissolution of the film, which may be due to the development of internal stress caused by rapid swelling, i.e., since for this film to remain on the substrate is not preferable, to perfect stripping a mechanism as disclosed as above is necessary. Further, perhaps due to such a drastic stripping mechanism, one cannot observe any tendency for an extremely thin film to remain on the substrate.

When the anti-halation layer is removed in the form of disintegrated pieces, these pieces of the layer which float in the rinsing water generally deposit on the photographic emulsion layer, thus interrupting development of the emulsion at the deposited areas. In the case of the present invention, however, wherein a blended binder comprising an aqueous alkali swellable polymer and an aqueous alkali soluble polymer is used, the size of the pieces of the removed layer from the substrate during rinsing with water are to small, i.e., about 100 microns or less and like a powder, to cause such a problem.

The anti-halation layer of the present invention most preferably has a dry thickness of from about 0.2 to about 2 microns.

Aqueous alkali swellable polymers can be prepared by various methods some of which are disclosed in the following examples.

PREPARATION EXAMPLE 1

Into a three neck flask were charged 180 g of acrylic acid, 200 g of ethyl acrylate, 550 g of methyl methacrylate, 2.8 g of azo-bis-isobutylonitrile (AIBN) and 1,000 g of methanol and the system heated under agitation for 5 hours at 60° C under nitrogen gas at atmospheric pressure. The contents which were like a solution were then introduced into a large volume of water, whereby the resulting polymer precipitated. The precipitate was dried at 100° C for 5 hours in air. The yield was 80 mol %.

The terpolymer thus obtained was purified by dissolving it in acetone to form a 30% by weight solution and then adding this solution into a large volume of water. The precipitate was again dried at 100° C for 5 hours in air. The dried product was ready for use as an anti-halation binder component. The viscosity of the purified terpolymer was 1.20 ( $\eta$ sp/C) when measured at 20° C at a concentration of 0.5 g/dl acetone.

PREPARATION EXAMPLE 2

Acrylic acid 144 g, butyl acrylate 192 g, methyl methacrylate 650 g, benzoyl peroxide 4.9 g, isopropyl alcohol 200 g and methanol 100 g were charged into a three-neck flask and heated under nitrogen gas at atmospheric pressure at 70° C for 3 hours with constant stirring. The polymer was precipitated in water as in preparation Example 1. The yield was 90 mol %. The viscosity ( $\eta$ sp/C) was 0.55 when measured in a 0.5 g/dl acetone solution at 20° C.

In the following examples, essential features of the present invention will be described. In the examples numerical values mean percent by weight.

EXAMPLE 1

One surface of a 140 micron thick cellulose triacetate substrate was coated with a conventional gelatin-silver halide photographic emulsion coating as disclosed in U.S. Pat. No. 3,615,522. On the other side of the substrate there was coated a solution of the following composition at a rate of 20 cc/m$^2$ which was then dried at 100° for 10 minutes to form an anti-halation layer.

| | | |
|---|---|---|
| A terpolymer comprising acrylic acid 25.0%, ethyl acrylate 20.0% and methyl methacrylate 55.0%. | | 2.0% |
| hydroxypropylmethylcellulose acetylphthalate | | 1.0% |
| (degree of substitution; | hydroxypropyl group | 0.27 |
| | methyl group | 1.88 |
| | acetyl group | 0.50 |
| | phthalyl group | 0.20 |
| Carbon black | | 1.0% |
| Methanol | | 50% |
| Acetone | | 46% |

The photographic material provided with such an anti-halation layer thus prepared was immersed in an aqueous alkaline solution (pH 10–11) which is for removing an anti-halation layer and which comprised $Na_2B_4O_7$ 20g, $Na_2SO_4$ 100g, NaOH 1g, and $H_2O$ 1,000 g, at 15° C for 15 sec. and then transferred to rinsing bath whereby the anti-halation layer was perfectly removed in the form of finely divided particles in only 10 sec., leaving no trace of a thin film. The rinsing was conducted using 15° C water, 5 liters/min. for 30 sec. in Ex 2–5, the rinsing conditions were the same as above.

Moreover, when one rubbed the film just after it was taken out from the alkaline solution with a commercially available rubber roller for ferro-type machine, the anti-halation layer was not stripped.

EXAMPLE 2

In order to evaluate the effect of the aqueous alkali solution swellable polymer, a comparative anti-halation layer was coated as in Example 1 using a coating mixture of the following composition which did not contain any aqueous alkali solution swellable polymer.

| | | |
|---|---|---|
| Hydroxypropylmethylcellulose acetylphthalate | | 3.0% |
| Degree of substitution; | hydroxypropyl group | 0.27 |
| | methyl group | 1.88 |
| | acetyl group | 0.50 |
| | phthalyl group | 0.20 |
| Carbon black | | 1.0% |
| Methanol | | 50% |
| Acetone | | 46% |

After the photographic film having such an anti-halation layer was immersed for 15 sec. in the aqueous alkaline solution of Example 1 at 15° C for removal of the anti-halation layer the film was rinsed with water, whereby an incomplete removal by dissolving of the anti-halation layer took place, leaving a thin film of the anti-halation layer remaining on the substrate surface.

Moreover, when rubbed with a rubber roller for a ferrotype machine after immersion in the alkaline solution, the anti-halation layer was mostly entirely scraped off and adhered to the rubber roller.

EXAMPLE 3

On a biaxially oriented, crystallized polyethylene terephthalate film (100 μ thick) there was provided a subbing layer comprising 90 wt % cellulose triacetate and 10 wt % of a copolyester (molecular weight: about 40,000; as disclosed in U.S. Pat. No. 3,492,122) comprising 1 mole of terephthalic acid, 0.5 mole of ethylene glycol and 0.3 mole of triethylene glycol at a dry thickness of about 1 μ. A coating mixture of the following composition was overcoated on the subbing layer at a coating rate of 20 cc/m$^2$, and then dried at 90° C for 1 min. to form an anti-halation layer.

| | |
|---|---|
| A terpolymer comprising acrylic acid, ethyl acrylate and methyl methacrylate (27%:23%:50% respectively) | 2.0% |
| A styrene-maleic anhydride copolymer (copolymerization molar ratio; 1:1, molecular weight, about 50,000) | 1.0% |
| Carbon black | 1.0% |
| n-propyl alcohol | 26% |
| Acetone | 50% |
| Methylcellosolve acetate | 20% |

The anti-halation layer thus prepared was processed as in Example 1; the stripping thereof was satisfactory and the layer was not damaged when rubbed with the rubber roller.

EXAMPLE 4

The procedure of Example 3 was repeated except that the anti-halation layer was formed with the following solution. Equivalent results were obtained for stripping of the layer as well as for the resistance to the rubbing with rubber roller.

| | |
|---|---|
| A terpolymer of acrylic acid, ethyl acrylate and ethyl methacrylate (25%: 19%: 56%; respectively) | 2.5% |
| Hydroxypropylmethylcellulose acetylphthalate (the same compound as was used in Example 1) | 1.0% |
| Carbon black | 1.0% |
| Methanol | 30% |
| Acetone | 45.5% |
| Methylcellosolve acetate | 20% |

EXAMPLE 5

The procedure described in Example 3 was repeated except that the anti-halation layer was formed by coating the following coating mixture. The resulting anti-halation layer was satisfactorily removed and withstood the rubbing with a rubber roller without damage.

| | |
|---|---|
| A terpolymer of itaconic acid, ethyl acrylate and methyl methacrylate (27%: 15%: 58%; respectively) | 2.5% |
| Hydroxypropylmethylcellulose acetylphthalate (the same compound as was used in Example 1) | 1.0% |
| Carbon black | 1.0% |
| Methanol | 30.0% |
| Acetone | 45.5% |
| Methyl cellosolve acetate | 20.0% |

While the invention has been described in detail and with reference to specific embodiments thereof, it will be apparent to one skilled in the art that various changes and modifications can be made therein without departing from the spirit and scope thereof.

What is claimed is:

1. A phographic material having an anti-halation layer comprising at least one aqueous alkali solution swellable binder and at least one aqueous alkali solution soluble binder, said aqueous alkali solution swellable binder being a terpolymer comprising about 10 to about 25% by weight of an alkyl acrylate unit where said alkyl group contains from 1 to 4 carbon atoms, 52 to 65% by weight of an alkyl methacrylate unit where said alkyl group contains from 1 to 4 carbon atoms, and about 18 to about 30% by weight of an acid monomer selected from acrylic, methacrylic or itaconic acid; and said aqueous alkali solution soluble binder having a molecular weight of from about 10,000 to about 200,000.

2. The photographic material as claimed in claim 1, wherein said terpolymer has a molecular weight of from about 5,000 to about 200,000.

3. The photographic material as claimed in claim 2, wherein said terpolymer has a molecular weight of from 10,000 to 100,000.

4. The photographic material as claimed in claim 1, wherein said aqueous alkali solution soluble binder contains at least one free carboxyl group.

5. The photographic material as claimed in claim 4, wherein said soluble binder is a copolymer containing an organic acid, a cellulose derivative containing carboxy group, or a mixture thereof.

6. The photographic material as claimed in claim 4, wherein said copolymer is a copolymer of maleic acid or maleic anhydride and styrene or vinyl acetate.

7. The photographic material as claimed in claim 6 wherein said copolymer comprises from about 30 to about 60 mol% maleic acid or maleic anhydride.

8. The photographic material as claimed in claim 5, wherein said cellulose derivative is cellulose acetate phthalate, cellulose acetate maleate, hydroxypropylmethylcellulose hexahydrophthalate, hydroxypropylmethylcellulose acetylphthalate or cellulose acetate succinate.

* * * * *